US005863193A

United States Patent [19]

Tleimat

[11] Patent Number: 5,863,193

[45] Date of Patent: Jan. 26, 1999

[54] BURNER ASSEMBLY

[75] Inventor: Joseph Tleimat, Mission Viejo, Calif.

[73] Assignee: Atlantic Richfield Company, Los Angeles, Calif.

[21] Appl. No.: 825,809

[22] Filed: Apr. 3, 1997

[51] Int. Cl.[6] ..... F23C 5/00

[52] U.S. Cl. ..... 431/8; 431/187; 431/284; 431/285

[58] Field of Search ..... 431/8, 278, 181, 431/154, 177, 178, 187, 174, 115, 284, 285

[56] References Cited

U.S. PATENT DOCUMENTS

| | | | |
|---|---|---|---|
| 3,033,273 | 5/1962 | Zink, Jr. et al. | 431/285 |
| 4,281,983 | 8/1981 | Goodnight et al. | 431/187 |
| 4,807,541 | 2/1989 | Masai | 431/284 |
| 4,925,387 | 5/1990 | Locanetto et al. | 431/187 |
| 5,154,598 | 10/1992 | Gooderham et al. | 431/284 |
| 5,342,192 | 8/1994 | Hirano | 431/284 |
| 5,634,785 | 6/1997 | Bury et al. | 431/284 |

*Primary Examiner*—James C. Yeung
*Attorney, Agent, or Firm*—Denton Anderson; Karen Peterka

[57] ABSTRACT

The invention provides a method for reconfiguring a burner assembly having an air register, a central burner tip adapted to burn fuel oil, and a plurality of peripheral burner tips adapted to burn a combustion gas. The method is directed to such burner assemblies wherein substantially all of the combustion oxygen is provided by air directed into the air register. The method comprises the steps of replacing the oil-burning central tip with a gas-burning central tip and connecting the central tip to a source of combustion gas. The invention further provides a burner assembly having characteristics of the reconfigured burner assembly prepared from the method of the invention, namely a burner assembly having: an air register, a central burner tip and a plurality of peripheral burner tips, wherein the central burner tip is connected to a combustion gas conduit which has an eductor for drawing combustion oxygen into the central burner tip from a location outside the air register.

10 Claims, 2 Drawing Sheets

BURNER ASSEMBLY

FIELD OF THE INVENTION

This invention relates generally to industrial burner assemblies, and specifically to burner assemblies used in petroleum refinery crude oil heaters.

BACKGROUND

Large burner assemblies are used in a wide variety of industrial applications. Such burner assemblies are commonly used, for example, in petroleum refinery operations to supply the large quantities of heat necessary for crude oil distillation.

One particular burner assembly is illustrated in FIG. 1. This burner assembly comprises a cylindrical air register, a large-diameter burner riser disposed along the central axis of the air register, and a plurality of small-diameter burner risers disposed in a circular pattern around the large-diameter burner riser. Typically, fuel oil is burned at a burner tip disposed at the top of the large-diameter burner riser and natural gas or a suitable fuel gas is burned at burner tips disposed at the top of the small-diameter burner risers. Combustion oxygen is provided to all of the burner tips by heated air which is force-fed into the air register by one or more air movers such as blowers or fans.

Operators of this type of burner assembly, however, have frequently found that post-installation attempts to increase the capacity of this type of burner assembly are restricted by the amount of combustion oxygen which can be economically forced into the air register. Thus, when operators have found that their post-installation operating conditions require additional burner capacity, an entirely new burner is often purchased and installed.

Accordingly, there is a need for a method of reconfiguring burner assemblies such as shown in FIG. 1 to provide corresponding burner assemblies with significantly increased capacity.

SUMMARY

The invention satisfies this need. The invention is a method for reconfiguring an initial burner assembly having (i) an air register with substantially vertical side walls and at least one opening for the passage of combustion oxygen into the air register, (ii) a central burner riser disposed substantially vertically within the air register, the central burner riser having an open first end fitted with a central burner liquid fuel burner tip adapted for sustaining combustion of a liquid fuel, and a second end disposed in fluid tight communication with a central burner liquid fuel conduit, and (iii) a plurality of peripheral burner risers disposed substantially vertically within the air register, each peripheral burner riser having an open first end fitted with a peripheral burner combination gas burner tip adapted for sustaining combustion of a combustion gas, and a second end disposed in fluid tight communication with a peripheral burner combustion gas conduit.

The method comprises the steps of (a) disconnecting the second end of the central burner riser from the central burner liquid fuel conduit and reconnecting the second end of the central burner riser in fluid tight communication with a central burner combustion gas conduit, the central burner combustion gas conduit being in fluid tight communication with a source of combustion gas, (b) replacing the central burner liquid fuel burner tip with a central burner combustion gas burner tip adapted for sustaining combustion of a combustion gas, and (c) disposing within the central burner combustion gas conduit an eductor for drawing combustion oxygen into the central burner riser from a location outside of the air register.

If the initial burner assembly has refractory surrounding the central burner tip, the invention can also comprise the additional step of removing such refractory.

The invention is also a burner assembly having characteristics of the reconfigured burner assembly prepared from the method of the invention, namely a burner assembly comprising: (a) an air register having side walls and at least one opening for the passage of combustion oxygen into the air register, (b) a central burner riser disposed substantially vertically within the air register, the central burner riser having an open first end fitted with a central burner combustion gas burner tip adapted for sustaining combustion of a combustion gas, and a second end disposed in fluid tight communication with a central burner combustion gas conduit, and (c) a plurality of peripheral burner risers disposed substantially vertically within the plenum chamber, each peripheral burner riser having an open first end fitted with a peripheral combustion gas burner tip adapted to sustain combustion of a combustion gas, and a second end disposed in fluid tight communication with a peripheral burner combustion gas conduit, wherein the central burner combustion gas conduit comprises an eductor for drawing combustion oxygen into the central burner riser from a location outside of the air register.

The invention provides a simple and relatively inexpensive method of reconfiguring burner assemblies of the type shown in FIG. 1 to markedly increase the capacity of such burner assemblies.

DRAWINGS

These features, aspects and advantages of the present invention will become better understood with regard to the following description, appended claims and accompanying figures where:

DESCRIPTION OF THE INVENTION

Figure 1:
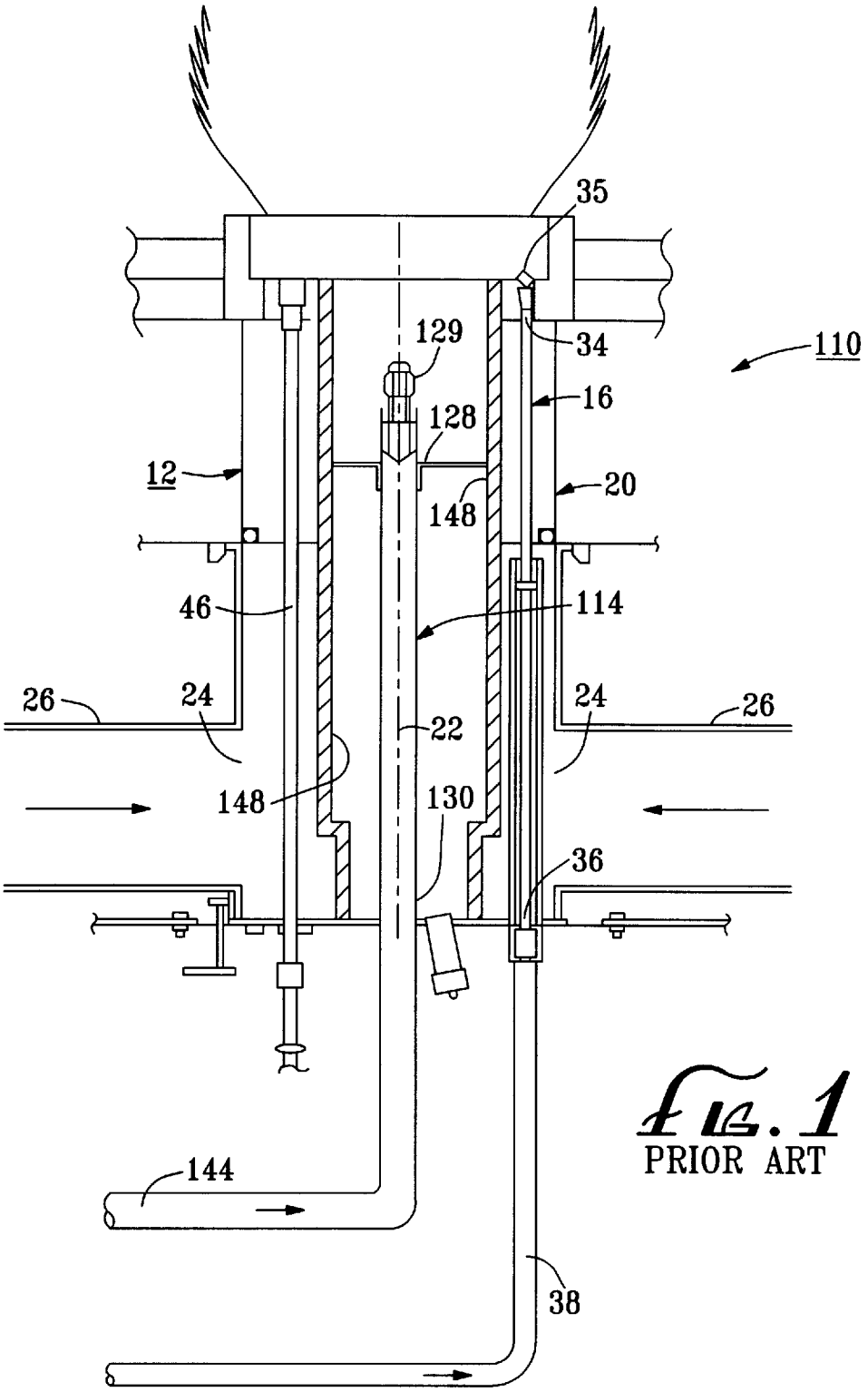
FIG. 1 PRIOR ART
FIG. 1 is a side elevation in partial cross-section of a burner assembly of the prior art.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a method for reconfiguring an initial burner assembly 110 having (i) an air register 12 with side walls 20 and a longitudinal axis 22 disposed in parallel with the side walls 20. The air register 12 has at least one opening 24 for the passage of combustion oxygen into the air register 12, (ii) a central burner riser 114 disposed substantially vertically within the register 12 in parallel with the longitudinal axis 22, the central burner riser 114 having an open first end 128 fitted with a central burner liquid fuel burner tip 129 adapted for sustaining combustion of a liquid fuel, and a second end 130 disposed in fluid tight communication with a central burner liquid fuel conduit 144, and (iii) a plurality of peripheral burner risers 16 disposed substantially vertically within the air register 12, typically at a location between the central burner riser 114 and the side walls 20, each peripheral burner riser 16 having an open first end 34 fitted with a peripheral burner combustion gas burner tip 35 of a combustion gas and a second end 36 disposed in fluid tight communication with a peripheral burner combustion gas conduit 38.

The method comprises the steps of (a) disconnecting the central burner riser 114 from the central burner liquid fuel conduit 144 and reconnecting the second end 130 of the central burner riser 114 in fluid tight communication with a central burner combustion gas conduit (such as combustion gas conduit 38), the central burner combustion gas conduit 32 being in fluid tight communication with a source of combustion gas, (b) replacing the central burner liquid fuel burner tip 129 with a central burner combustion gas tip 29 adapted to sustain combustion of a combustion gas, and (c) disposing within the central burner combustion gas conduit 32 an eductor 42 for drawing combustion oxygen into the central burner riser 114 from a location outside of the air register 12.

In a typical initial burner assembly 110, the air register 12 has a relatively elongated cylindrical shape having a diameter of between about 1 and about 4 feet and a height of between about 1 and about 6 feet. Defined in one of the side walls 20 of the air register 12 is at least one opening 24 for drawing combustion oxygen into the air register 12 for sustaining combustion at each of the peripheral burner combustion gas tips 35. Typically, such opening 24 connects the interior of the air register 12 in fluid tight communication with a peripheral burner combustion oxygen conduit 26 which is connected to a source of combustion air. Such source of combustion air can be heated air which is pressured into the combustion oxygen conduit 26 by blowers or fans (not shown). Substantially all of the combustion oxygen to the initial burner assembly 110—including combustion oxygen for the central burner riser liquid fuel burner tip 129—is provided by combustion oxygen flowing into the air register 12 via the opening 24 and the combustion oxygen conduit 26.

The central burner riser 114 is connected via a central burner liquid fuel conduit 144 with a source of liquid combustion fuel, such as fuel oil.

Also in a typical initial burner assembly 110, the peripheral burner risers 16 are disposed in a circular pattern such that each peripheral burner riser 16 is equidistant from adjoining peripheral burner risers 16 to each side. In most applications, the burner assembly 110 comprises at least four peripheral burner risers 16. In larger burner assemblies 110, eight or more peripheral burner risers 16 are be used. Typically, each peripheral burner riser 16 is a cylindrical steel conduit having an internal diameter of between about ⅞ and about ¾ inches.

A pilot burner riser 46 is also typically provided within the initial burner assembly 110. Such pilot burner riser 46 is typically connected in fluid tight communication with a source of natural gas or fuel gas (not shown).

If the initial burner assembly 110 has refractory 148 surrounding the central burner riser 114 (such as is shown in FIG. 1), the invention can also comprise the additional step of removing such refractory 148.

Figure 2:
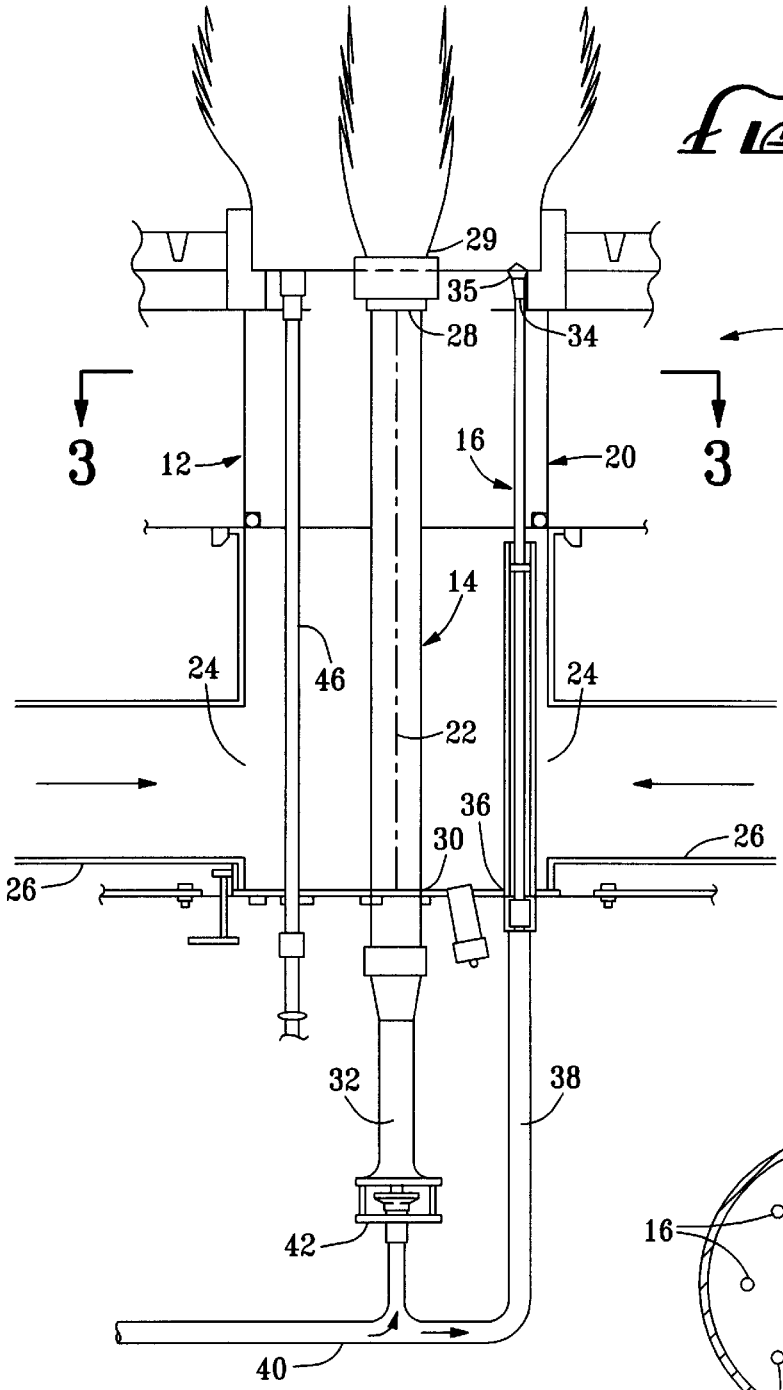
FIG. 2 is a side elevation in partial cross-section of a burner assembly having features of the invention.
Figure 3:
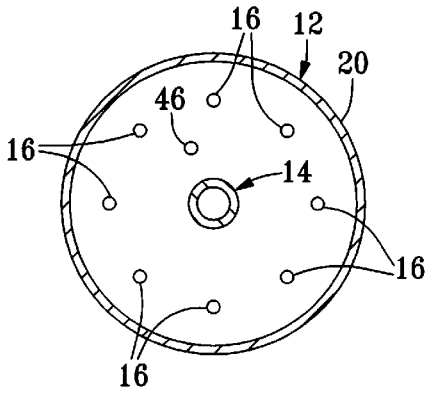
FIG. 3 is a cross-sectional view of the burner assembly of FIG. 2 taken along the line 3—3.

After reconfiguration, the reconfigured burner assembly 10 is typically as shown in FIGS. 2 and 3. A gas-burning central burner riser 14 is disposed substantially vertically along the longitudinal axis 22 of the air register 12. The central burner riser 14 has a first end 28 and a second end 30. The first end 28 is fitted with a central burner combustion gas burner tip 29 adapted for combustion of a combustion gas at the first end 28. The second end 30 is disposed in fluid tight communication with a central burner gas conduit 32. The central burner tip combustion gas conduit 32 is in fluid tight communication with a source of natural gas or fuel gas (not shown). As shown in FIG. 2, the central burner tip combustion gas conduit 32 and the peripheral burner combustion gas conduit 38 can be connected to a single combustion gas header conduit 40 which is connected in fluid tight communication with the source of natural gas or suitable fuel gas.

An eductor 42 is disposed within the central burner combustion gas conduit 32. The eductor 42 is adapted to draw combustion air into the central burner riser 14 as combustion gas flows through the central burner combustion gas conduit 32 to the central burner riser 14. The eductor 42 draws combustion oxygen from a location outside of the air register 12. Typically, this is accomplished by disposing the eductor 42 outside of the air register 12 such that the eductor 42 draws atmospheric air into the central burner combustion gas conduit 32.

A typical eductor 42 useful in the invention is a mixer type of eductor such as the Model PM-7-4HC eductor sold by John Zink Company of Tulsa, Okla.

The invention is also a burner assembly 10 having characteristics of the reconfigured burner assembly 10 prepared from the method of the invention. Such a burner assembly 10 comprises: an air register 12, a central burner riser 14 and a plurality of peripheral burner risers 16. The air register 12 has side walls 20 and a longitudinal axis 22 disposed in parallel with the side walls 20. The air register 12 has at least one opening 24 for the passage of combustion oxygen into the air register 12. The central burner riser 14 is disposed substantially vertically within the air register 12 in parallel with the longitudinal axis 22 and has an open first end 28 fitted with a central burner combustion gas burner tip 29 adapted for sustaining combustion of a combustion gas at such first end 28 and a second end disposed in fluid tight communication with a central burner combustion gas conduit 32. The plurality of peripheral burner risers 16 are disposed in parallel with the central burner riser 14 within the air chamber 12, typically at a location between the central burner riser 14 and the side walls 20. Each peripheral burner riser 16 has an open first end 34 fitted with a peripheral burner combustion gas tip 35 adapted for sustaining combustion of a combustion gas at such first end 34 and a second end 36 disposed in fluid tight communication with a peripheral burner combustion gas conduit 38. The central burner combustion gas conduit 32 comprises an eductor 42 for drawing combustion oxygen into the central burner riser 14 from a location outside of the air chamber 12.

The invention provides a simple and inexpensive burner assembly with markedly increased capacity.

Although the present invention has been described in considerable detail with reference to certain preferred embodiments thereof, other embodiments are possible. Therefore, the spirit and scope of the appended claims should not be limited to the description of the preferred embodiments contained herein.

What is claimed is:

1. A method for reconfiguring a burner assembly having (i) an air register with substantially vertical side walls and at least one opening for the passage of combustion oxygen into the air register, (ii) a central burner riser disposed substantially vertically within the air register, the central burner riser having an open first end fitted with a central burner liquid fuel burner tip adapted for sustaining combustion of a liquid fuel and an open second end attached in fluid communication with a central burner liquid fuel conduit, and (iii) a plurality of peripheral burner risers disposed substantially vertically within the air register, each peripheral burner riser having an open first end fitted with a peripheral burner combustion gas burner tip adapted for sustaining combustion of a combustion gas and a second end disposed in fluid tight communication with a peripheral burner combustion gas conduit, the method comprising the steps of:

(a) disconnecting the second end of the central burner riser from the liquid fuel conduit and reconnecting the second end of the central burner riser in fluid tight communication with a central burner combustion gas conduit, the central burner combustion gas conduit being in fluid tight communication with a source of combustion gas;

(b) replacing the central burner liquid fuel burner tip with a central burner combustion gas burner tip adapted for sustaining the combustion of a combustion gas; and (c) disposing within the central burner combustion gas conduit an eductor for drawing combustion oxygen into the central gas burner riser from a location outside of the air register.

2. The method of claim 1 wherein the burner assembly comprises refractory disposed along the inside of the air register vertical side walls and wherein the method comprises the additional step of removing such refractory.

3. The method of claim 1 wherein the plurality of peripheral burner risers is at least four.

4. The method of claim 1 wherein the plurality of peripheral burner risers is at least eight.

5. The method of claim 1 wherein the air register is cylindrical and has a diameter between about 1 and about 6 feet.

6. The method of claim 1 wherein the eductor is disposed outside of the air register.

7. A burner assembly comprising:

(a) an air register with substantially vertical side walls and at least one opening for the passage of combustion oxygen into the air register;

(b) a central burner riser disposed substantially vertically within the air register, the central burner riser having an open first end fitted with a central burner combustion gas burner tip adapted for sustaining combustion of a combustion gas and a second end disposed in fluid tight communication with a central burner combustion gas conduit; and (c) a plurality of peripheral burner risers disposed substantially vertically within the air register, each peripheral burner riser having an open first end fitted with a peripheral burner combustion gas burner tip adapted for sustaining combustion of a combustion gas and a second end disposed in fluid tight communication with a peripheral burner combustion gas conduit;

wherein the central burner combustion gas conduit comprises an eductor for drawing combustion oxygen into the central burner riser from a location outside of the air register.

8. The burner assembly of claim 7, wherein the plurality of peripheral burner risers is at least four.

9. The burner assembly of claim 7, wherein the plurality of peripheral burner risers is at least eight.

10. The burner assembly of claim 7, wherein the air register is cylindrical and has a diameter between about 1 and about 6 feet.

* * * * *